US006371790B1

(12) United States Patent
Huang

(10) Patent No.: US 6,371,790 B1
(45) Date of Patent: Apr. 16, 2002

(54) ELECTRICAL ASSEMBLY HAVING ANTI-MISMATING DEVICE

(75) Inventor: Chien-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,613

(22) Filed: Dec. 27, 2000

(30) Foreign Application Priority Data

Dec. 21, 2000 (TW) ..... 89222262

(51) Int. Cl.[7] ..... H01R 13/629
(52) U.S. Cl. ..... 439/378; 439/680
(58) Field of Search ..... 439/378–381, 439/78, 680, 681

(56) References Cited

U.S. PATENT DOCUMENTS 5,429,520 A * 7/1995 Morlion et al. ..... 439/108
5,443,401 A * 8/1995 Champion et al. ..... 439/680
5,620,329 A * 4/1997 Kidd et al. ..... 439/378
5,634,810 A * 6/1997 Niitsu et al. ..... 439/378

* cited by examiner

*Primary Examiner*—Gary F. Paumen
(74) *Attorney, Agent, or Firm*—Wei Te Chung

(57) ABSTRACT

An electrical connector assembly (1) comprises first and second electrical connectors (10), (20) mounted onto mother and daughter boards, respectively. The first connector comprises a first insulative body (12) receiving a matrix of first terminal pins (14). A guiding post (16) is integrally formed with the first insulative body, and forms a plurality of latching ribs (162) thereon. The second connector comprises a second insulative body (22) receiving a matrix of second conductive contacts (24) for mating with respective first terminal pins. The second insulative body defines a receiving hole (26) with a plurality of recessed slots (262), for engaging with the corresponding ribs of the guiding post of the first connector. Thus, mismating of the first and second connectors is prevented. The anti-mismating means are easily manufactured thereby reducing costs.

1 Claim, 4 Drawing Sheets

ELECTRICAL ASSEMBLY HAVING ANTI-MISMATING DEVICE

BACKGROUND OF THE INVENTION

1. Field of the Invention

The present invention relates to an electrical connector assembly for interconnecting high frequency signal circuits on backplanes, daughter boards and other similar substrates, and particularly to such an electrical connector assembly having an anti-mismating device.

2. Description of Related Art

With the development of communications and computer technology, a high density connector assembly with terminal pins arranged in a matrix has been devised to electrically connect a mother board with a daughter board. Such an electrical connector assembly is known as a future bus connector assembly. It comprises a plug connector mounted on a mother board, and a receptacle connector mounted on a daughter board for engaging with the plug connector.

U.S. Pat. Nos. 5,443,401 and 5,429,520 disclose such future bus connector assemblies. These kinds of connector assemblies comprise a series of plug and receptacle connectors having different standards yet also similar configurations. Therefore, a user can easily mistakenly attempt to mate a plug connector with an incompatible receptacle connector. This frequently results in bending, displacement, or damage to the terminal pins or the connectors.

Other conventional fixture bus connector assemblies have guiding posts on insulative housings thereof, to solve the above-mentioned problems. However, the guiding posts are metallic, and cannot be integrally formed with the insulative housings which are made from non-metallic materials such as plastic. Thus, manufacturing such connector assemblies is unduly complicated and costly.

Hence, an improved future bus connector assembly is required to overcome the disadvantages of the prior art.

BRIEF SUMMARY OF THE INVENTION

A first object of the present invention is to provide an electrical connector assembly having an anti-mismating device for preventing an electrical connector from being mismating with another incompatible electrical connector.

A second object of the present invention is to provide an electrical an connector assembly having an anti-mismating device which is easily and cost-effectively manufactured.

To fulfill the above-mentioned objects, an electrical connector assembly of the present invention comprises first and second electrical connectors mounted onto mother and daughter boards, respectively. The first connector comprises a first insulative body receiving a matrix of first terminal pins, and a guiding post integrally formed with the first insulative body. The guiding post forms a plurality of longitudinally extending, circumferentially spaced latching ribs. The second connector comprises a second insulative body receiving a matrix of second conductive contacts for mating with respective first terminal pins. The second insulative body defines a receiving opening for accommodating the guiding post of the first electrical connector. A plurality of recessed slots is defined in communication with the receiving opening, for receiving the latching ribs of the guiding post. Thus mismating of the first and second connectors is prevented. The anti-mismating means are easily and integrally manufactured, thereby reducing costs.

Other objects, advantages and novel features of the invention will become more apparent from the following detailed description of the preferred embodiment when taken in conjunction with the accompanying drawings.

DETAILED DESCRIPTION OF THE INVENTION

Figure 1:
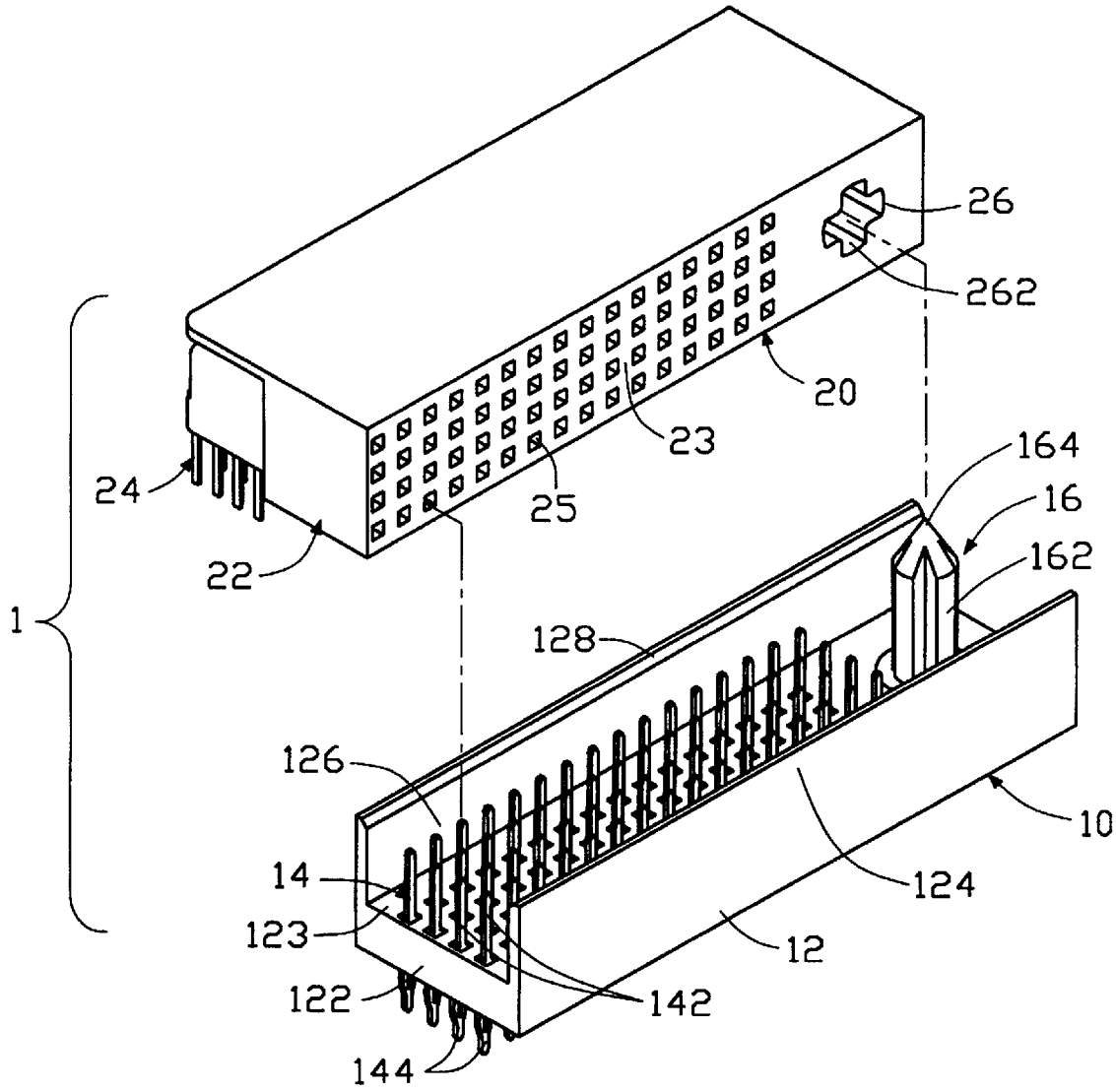
FIG. 1 is an exploded view of an electrical connector assembly in accordance with the present invention.
Figure 2:
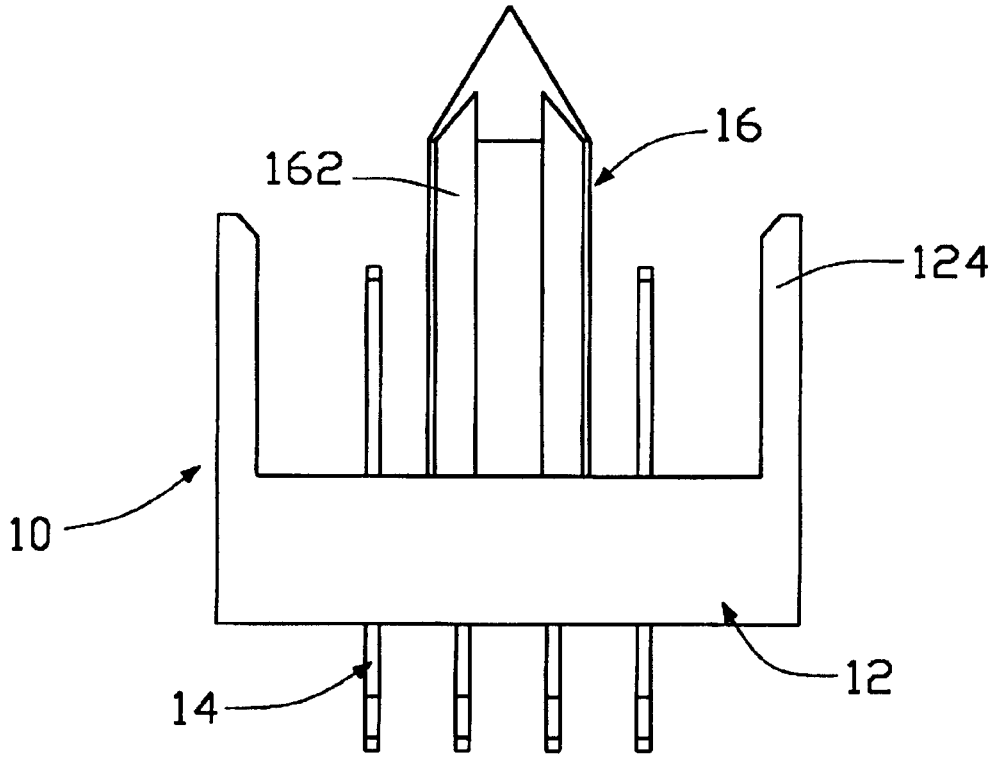
FIG. 2 is a side view of a first electrical connector of the electrical connector assembly of FIG. 1.
Figure 3:
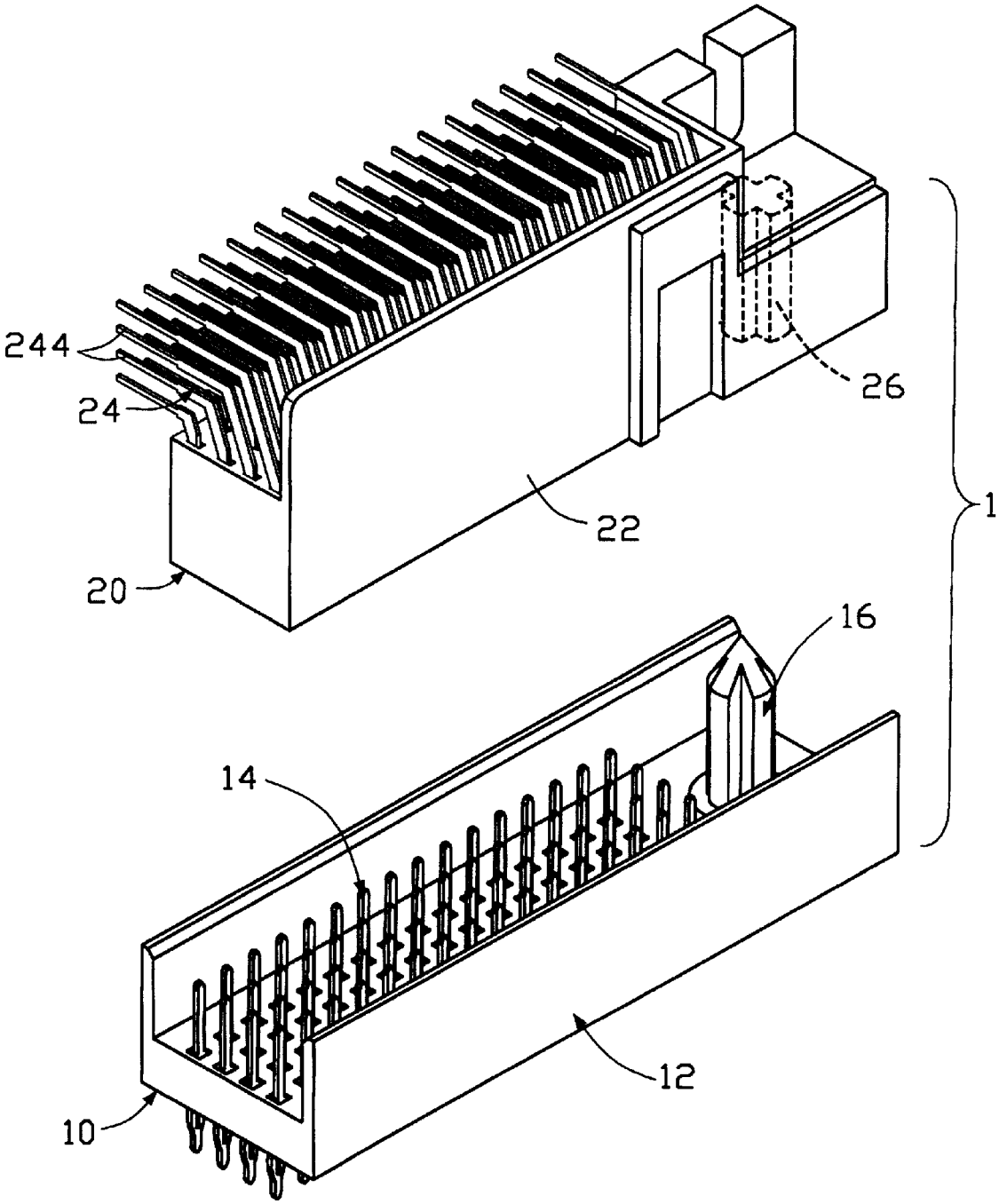
FIG. 3 is a perspective view of the electrical connector assembly of FIG. 1 partly assembled.

Referring to FIGS. 1 to 3, an electrical connector assembly 1 in accordance with the present invention comprises a first electrical connector 10, i.e. a "pin header", for mounting on the a mother board (not shown), and a second electrical connector 20, i.e. a "receptacle", for mounting onto a daughter board (not shown).

The first connector 10 comprises a U-profiled first insulative body 12, and a matrix of first terminal pins 14 retained in first insulative body 12. The first insulative body 12 includes a base 122 and two opposite side walls 124 extending from the base 122, all of which cooperatively define an open receiving space 126. The first terminal pins 14 are retained in a corresponding number of passageways (not labeled) defined in the base 122. Each first terminal pin 14 comprises a mating portion 142 and a tail portion 144. The mating portion 142 projects into the receiving space 126 from a top surface 123 of the base 122, and extends upwardly to a point lower than a top edge 128 of the first insulative body 12. The tail portion 144 is a press-in fit type. The tail portion 144 depends from a bottom surface (not labeled) of the base 122 opposite to the top surface 123, for insertion into a corresponding hole (not shown) defined in the mother board.

A guiding post 16 is made of the same material as that of the first insulative body 12 such as plastic or the like, and is integrally formed with the first insulative body 12 by insert molding means. The guiding post 16 extends upwardly from the top surface 123 of the base 122 to a point higher than the top edge 128 of the first insulative body 12. A plurality of longitudinally extending, circumferentially spaced latching ribs 162 are formed on the guiding post 16. The latching ribs 162 are tapered toward a tip 164 of the guiding post 16, for facilitating insertion of the guiding post 16 into a receiving hole 26 defined in the second connector 20.

The second connector 20 includes a second insulative body 22, and a matrix of second conductive contacts 24 received in respective second passageways 25 defined in the second body 22. Each second contact 24 comprises an engaging portion (not shown) recessed from an engaging face 23 of the second connector 20 for engaging with the mating portion 142 of a respective first terminal pin 14, and a soldering portion 244 projecting from the second body 22 for soldering to the daughter board.

The receiving hole 26 is integrally defined in the engaging face 23, and is dimensioned to allow accommodation of the guiding post 16 therein. A plurality of recessed slots 262 is defined in the engaging face 23 adjacent and in communication with the receiving hole 26, defines a for accommodating the corresponding ribs 162 of the first connector 10.

Figure 4:
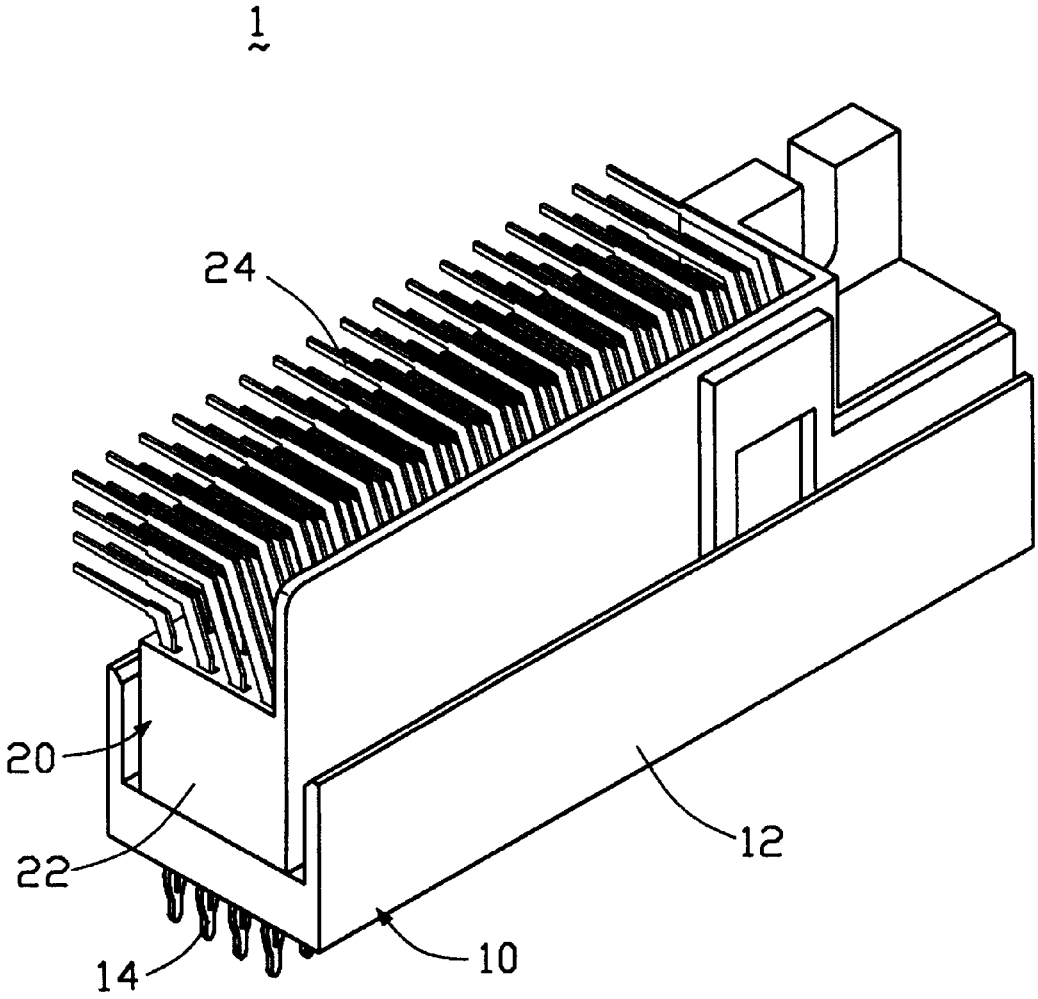
FIG. 4 is a fully assembled view of FIG. 3.

In assembly, referring also to FIG. 4, the first connector 10 is mounted onto the mother board with the tail portions 144 of the terminal pins 14 press-in fitted into the corresponding holes of the mother board. The second connector 20 is mounted onto the daughter board, with the soldering portions 244 of the contacts 24 being soldered to the daughter board. In use, the first connector 10 is oriented toward the second connector 20, with the top edges 128 of the first connector 10 confronting to the engaging face 23 of the second connector 20. The tip 164 of the guiding post 16 of the first connector 10 is progressively inserted into the receiving hole 26 of the second connector 20. The latching ribs 162 of the guiding post 16 are received in the recessed slots 262 of the receiving hole 26. Thus, the guiding post 16 is correctly inserted into the receiving hole 26 before the first terminal pins 14 of the first connector 10 engage with respective second conductive contacts 24 of the second connector 20. The first terminal pins 14 are therefore properly engaged with the second conductive contacts 24. Mismating is prevented, and bending, displacement or damage due to improper insertion force is avoided.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for interconnecting mother and daughter boards, comprising:

a first electrical connector mounted onto the mother board and comprising a first insulative body and a matrix of first terminal pins retained in the first insulative body, a guiding post being integrally formed as one piece with the first insulative body and having latching ribs thereon; and a second electrical connector mounted onto the daughter board and comprising a second insulative body and a matrix of second conductive contacts for mating with corresponding first terminal pins, the second insulative body defining a receiving hole having recessed slots for engaging with the ribs of the guiding post of the first electrical connector;

wherein each rib of the guiding post extends longitudinally therealong;

wherein the ribs are spaced circumferentially from each other;

wherein the guiding post is made from the same material as the first insulative body;

wherein the guiding post extends beyond a top edge of the first electrical connector, and the first terminal pins extend to a height lower than the top edge;

wherein the guiding post forms a tapered tip for facilitating insertion of the guiding post into the receiving hole of the second connector;

wherein the receiving hole is defined in a position for receiving the guiding post therein.

* * * * *